US008197363B1

(12) United States Patent
Davignon

(10) Patent No.: US 8,197,363 B1
(45) Date of Patent: Jun. 12, 2012

(54) TRAINING BASEBALL AND METHOD OF USING THE SAME

(76) Inventor: Robert W. Davignon, Terre Haute, IN (US)

( * ) Notice: Subject to any disclaimer, the term of this patent is extended or adjusted under 35 U.S.C. 154(b) by 22 days.

(21) Appl. No.: 12/886,204

(22) Filed: Sep. 20, 2010

(51) Int. Cl.
*A63B 69/00* (2006.01)
*A63B 43/00* (2006.01)
*A63B 39/00* (2006.01)

(52) U.S. Cl. ..... 473/451; 473/422; 473/613; 473/458

(58) Field of Classification Search ..... 473/422, 473/451, 450, 458, 604, 614, 612, 613, 596; D21/708, 712, 713, 714
See application file for complete search history.

(56) References Cited

U.S. PATENT DOCUMENTS

| | | | | | |
|---|---|---|---|---|---|
| 2,078,382 | A | * | 4/1937 | Hanshaw | 473/595 |
| 2,129,238 | A | * | 9/1938 | Riddell | 473/604 |
| 2,278,649 | A | | 4/1942 | Dickson et al. | |
| 3,110,494 | A | * | 11/1963 | Morgan | 473/458 |
| 3,152,803 | A | | 10/1964 | Sain, Jr. | |
| 3,758,985 | A | * | 9/1973 | Heisler | 473/588 |
| 4,128,238 | A | | 12/1978 | Newcomb et al. | |
| 4,262,911 | A | * | 4/1981 | Opresik et al. | 473/613 |
| 4,286,783 | A | | 9/1981 | Newcomb et al. | |
| 4,580,990 | A | * | 4/1986 | Avery | 446/220 |
| 4,614,339 | A | | 9/1986 | Schanwald | |
| 4,875,689 | A | * | 10/1989 | Lin | 473/573 |
| 4,887,814 | A | * | 12/1989 | Winter | 473/596 |
| 4,919,422 | A | | 4/1990 | Ma | |
| 5,048,829 | A | * | 9/1991 | Prokupek | 473/595 |
| D322,105 | S | | 12/1991 | Ma | |
| 5,407,193 | A | | 4/1995 | McGinley | |
| D382,927 | S | * | 8/1997 | McGowen et al. | D21/712 |
| 5,674,101 | A | * | 10/1997 | Saloor | 473/613 |
| 5,788,591 | A | | 8/1998 | Decker | |
| D408,482 | S | * | 4/1999 | Morrison | D21/708 |
| 5,984,813 | A | | 11/1999 | Cinnella | |
| 6,220,980 | B1 | * | 4/2001 | Adler | 473/613 |
| 7,470,203 | B1 | * | 12/2008 | Stillinger | 473/596 |
| 7,572,210 | B2 | | 8/2009 | Marinello | |
| 7,608,003 | B1 | | 10/2009 | Fusco et al. | |
| D609,290 | S | | 2/2010 | Oblack et al. | |
| 7,753,811 | B2 | | 7/2010 | Mark | |
| 8,047,937 | B2 | * | 11/2011 | Krysiak | 473/603 |
| 2006/0068952 | A1 | | 3/2006 | Davignon, II | |
| 2006/0217220 | A1 | | 9/2006 | Davignon, II | |
| 2008/0108461 | A1 | * | 5/2008 | Krysiak | 473/603 |

* cited by examiner

*Primary Examiner* — Mitra Aryanpour

(57) ABSTRACT

The present invention is a training baseball. The training baseball includes elongated fins that cause the training baseball to have a curved flight when thrown in a straight-throw motion. The present invention also includes a method for using the training baseball.

15 Claims, 4 Drawing Sheets

TRAINING BASEBALL AND METHOD OF USING THE SAME

CROSS-REFERENCE TO RELATED APPLICATION

Not applicable.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to a training baseball, and more particularly the present invention relates to a training baseball having fins that provide greater ease in throwing curve balls.

2. Description of the Related Art

For a baseball player to be successful as a hitter, the player must be able to hit the ball against first class pitching. During an at bat, a first class pitcher can deliver a mix of straight balls of varying speeds and curve balls, which curve or "break" to a greater or lesser degree depending upon the speed and twist imparted to the ball.

Generally, a pitcher's arm is exposed to a greater amount of stress when throwing a curve ball as opposed to a straight ball. In addition to the usual throwing motion of the arm, a curve ball requires a rapid twisting movement of the hand, wrist, forearm, and elbow just before release of the ball. Thus, repeated throwing of curve balls puts so much stress on the pitcher's wrist and elbow that a "sore arm" is very likely to develop.

While a pitcher may be encouraged to utilize and throw curve balls in a game situation, coaches at all levels (little leagues through major leagues) are reluctant to call on their pitchers to throw many curve balls for the sake of batting practice lest the pitchers be incapacitated by the development of "sore arms." As a result, batters' opportunities to practice hitting curve balls are limited.

Attempts have been made to provide mechanical ball throwers capable of throwing curve balls. However, these machines are typically beyond the financial reach of schools and colleges where most baseball players receive their initial instruction and playing opportunities. Further, the mechanical ball thrower does not provide to the batter the game-like experience of seeing a pitcher deliver a pitch. Accordingly, the inability to practice at length against curveball pitching has proved to be a great disadvantage to batters in developing and improving their skills.

There are other balls disclosed in the prior art that allow for greater ease in throwing curve balls, but those balls each have one or more apertures, grooves, indentations, and/or some other departure from a spherical shape to provide a curved flight for the ball.

What is desired is a ball, without grooves or indentations, which engages in a curved flight upon being thrown in a straight-throw motion, such that a pitcher's arm is exposed to less stress and batters are able to practice hitting curve balls.

SUMMARY

Various exemplary embodiments of the present invention include a training baseball. The training baseball is comprised of a ball having a substantially spherical shape. The training baseball is also comprised of two or more elongated fins, wherein the two or more elongated fins project from an outer surface of the ball. The two or more elongated fins are positioned on substantially opposing sides of the ball.

Various exemplary embodiments of the present invention include a training baseball. The training baseball is comprised of a ball having a substantially spherical shape. The training baseball is also comprised of an elongated fin, wherein the elongated fin projects from an outer surface of the ball. The elongated fin is positioned substantially around a circumference of the ball, such that the elongated fin substantially creates a single plane. The single plane substantially bisects the ball to create a first side and a second side, wherein both the first side and the second side have a substantially hemispherical shape.

Various exemplary embodiments of the present invention include a method for throwing a training baseball. The method comprises the steps of gripping a training baseball. The training baseball is comprised of a ball having a substantially spherical shape. The training baseball is also comprised of two or more elongated fins, wherein the two or more elongated fins project from an outer surface of the ball. The two or more elongated fins are positioned on substantially opposing sides of the ball. The method also comprises the steps of throwing the training baseball in a straight-throw motion.

BRIEF DESCRIPTION OF THE DRAWINGS

The various exemplary embodiments of the present invention, which will become more apparent as the description proceeds, are described in the following detailed description in conjunction with the accompanying drawings, in which.

DESCRIPTION OF THE REFERENCED NUMERALS

Figure 1:
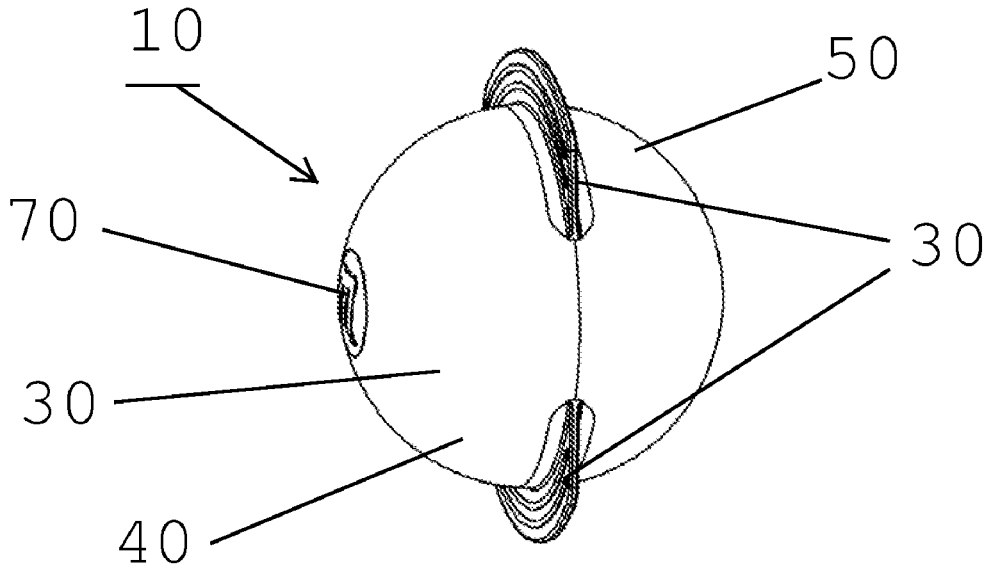
FIG. 1 is an illustrated perspective view of an exemplary embodiment of the present invention.

In reference to the drawings, similar reference characters denote similar elements throughout all the drawings. The following is a list of the reference characters and associated element:

10 training baseball

20 ball

30 elongated fin
40 first side
50 second side
60 wall thickness
70 dot

DETAILED DESCRIPTION

FIGS. 1-6 relate to a training baseball that allows for greater ease in throwing curve balls. The training baseball 10 is comprised of a ball 20 having a substantially spherical shape. The training baseball is also comprised of one or more elongated fins 30. The one or more elongated fins, which project from an outer surface of the ball, provide for a curved flight for the training baseball when thrown in a straight-throw motion.

It is preferred that the training baseball is comprised of two or more elongated fins. In such embodiments of the presently claimed invention, and as best shown in FIGS. 1-2, the two or more elongated fins are positioned on substantially opposing sides of the ball.

In a preferred embodiment of the presently claimed invention, and as best shown in FIG. 1, the two or more elongated fins are positioned on substantially opposing sides of a circumference of the ball, such that the fins are positioned substantially within a common plane. In such embodiments of the presently claimed invention, the common plane substantially bisects the ball to create a first side 40 and a second side 50, wherein both the first side and the second side have a substantially hemispherical shape.

Figure 2:
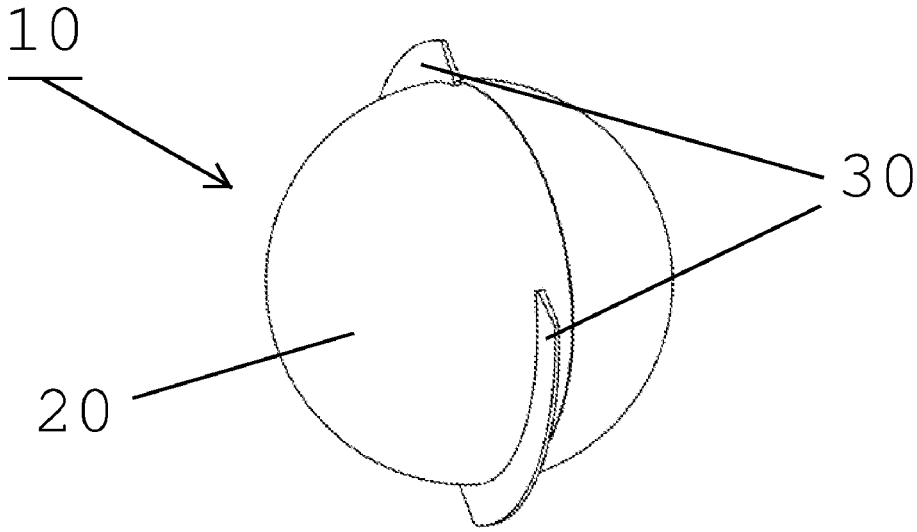
FIG. 2 is an illustrated perspective view of an exemplary embodiment of the present invention.
Figure 3:
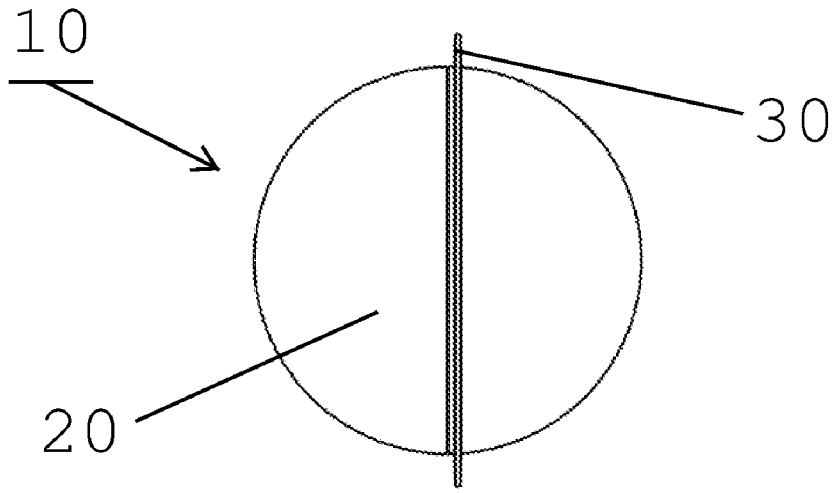
FIG. 3 is an illustrated side view of an exemplary embodiment of the present invention.

In another exemplary embodiment of the presently claimed invention, and as best shown in FIG. 2, the two or more elongated fins are positioned at an angle with respect to the circumference of the ball. And in another exemplary embodiment of the presently claimed invention, and as best displayed in FIG. 3, the elongated fin is positioned slightly off the circumference of the ball.

In a preferred embodiment of the presently claimed invention, and as best displayed in FIG. 1, the two or more elongated fins together do not extend completely around the circumference of the ball. Thus, in a preferred embodiment of the presently claimed invention, there are gaps between ends of the elongated fins. In such embodiments of the presently claimed invention, to avoid the two elongated fins becoming an inconvenience or source of discomfort for the individual, the gaps provide adequate space for an individual's throwing hand to grip the ball.

In a preferred embodiment of the presently claimed invention, the two or more elongated fins are pliant, such that the two or more elongated fins will substantially bend upon contact with a bat. In such an embodiment of the presently claimed invention, flexibility in the two or more elongated fins helps to prevent any bat damage that could result from a more rigid elongated fin, and similarly to the gaps, the flexibility also helps to avoid the two elongated fins becoming an inconvenience or source of discomfort for the individual.

Figure 4:
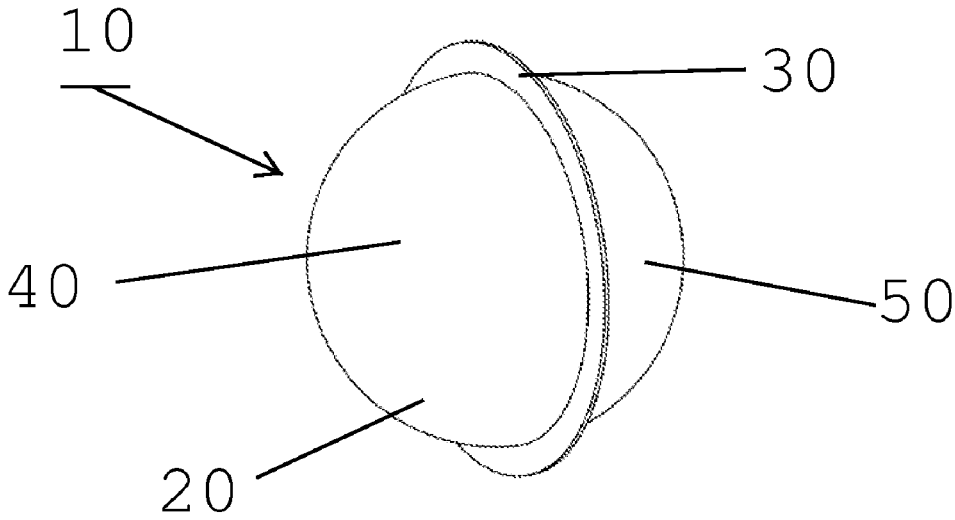
FIG. 4 is an illustrated perspective view of an exemplary embodiment of the present invention.

In an exemplary embodiment of the presently claimed invention, and as best displayed in FIG. 4, the training ball is comprised of one elongated fin. In such an embodiment of the present invention, the elongated fin is positioned substantially around a circumference of the ball, such that the elongated fin substantially creates a single plane. In such an embodiment of the presently claimed invention, the single plane substantially bisects the ball to create the first side and the second side.

In an exemplary embodiment of the presently claimed invention, the ball is substantially solid. However, in a preferred embodiment of the presently claimed invention, the ball is substantially hollow. In such an embodiment of the presently claimed invention, the ball is comprised of a wall thickness 60. And in such embodiments of the presently claimed invention, it is preferred that the wall thickness is uniform throughout the ball.

Figure 5:
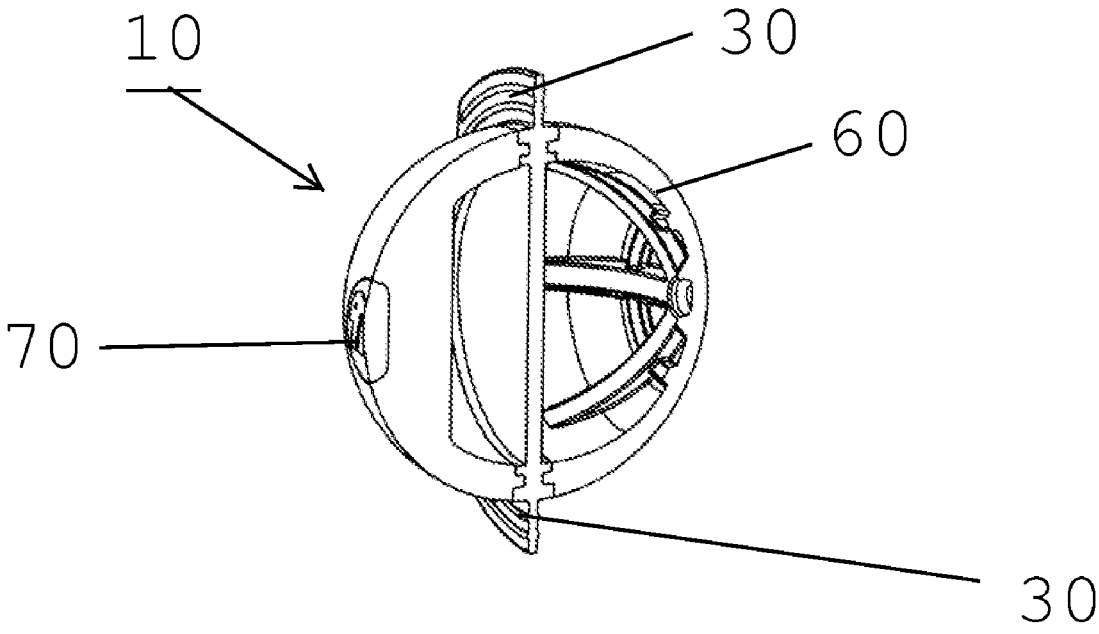
FIG. 5 is an illustrated cross-sectional view of an exemplary embodiment of the present invention.

In exemplary embodiments of the presently claimed invention, the first side has a first side weight and the second side has a second side weight, wherein the first side weight is greater than the second side weight. In an exemplary embodiment of the presently claimed invention, a difference in weight between the first side and the second side is the result of variations in wall thickness throughout the ball, which is shown in FIG. 5. In an exemplary embodiment of the presently claimed invention, the first side is comprised of a first side wall thickness and the second side is comprised of a second side wall thickness, wherein the first side wall thickness is greater than the second side wall thickness. In other exemplary embodiments of the present invention, a weighted member is applied to the first side, such that the first side weight is greater than the second side weight.

In a preferred embodiment of the presently claimed invention, a training baseball weight is near that of an official baseball. In such embodiments, the training baseball weight provides for a similar feel to an official baseball and helps to maintain a flight of the training baseball under windy conditions and when thrown at greater distances.

In a preferred embodiment of the presently claimed invention, the ball is further comprised of a marking. In such embodiments of the present invention, the marking is positioned on the outer surface of the ball substantially at a point at which a central axis passes through the outer surface on the first side, wherein the central axis extends through a center of the ball and is substantially perpendicular to the common plane, or in other exemplary embodiments, the single plane. In a preferred embodiment of the present invention, and as shown in FIGS. 1 and 5, the marking is a dot 70.

The presently claimed invention also relates to a method of using the training baseball. The method of throwing the training baseball of the presently claimed invention comprises the steps of gripping the training baseball and throwing the training baseball in a straight-throw motion.

Figure 6:
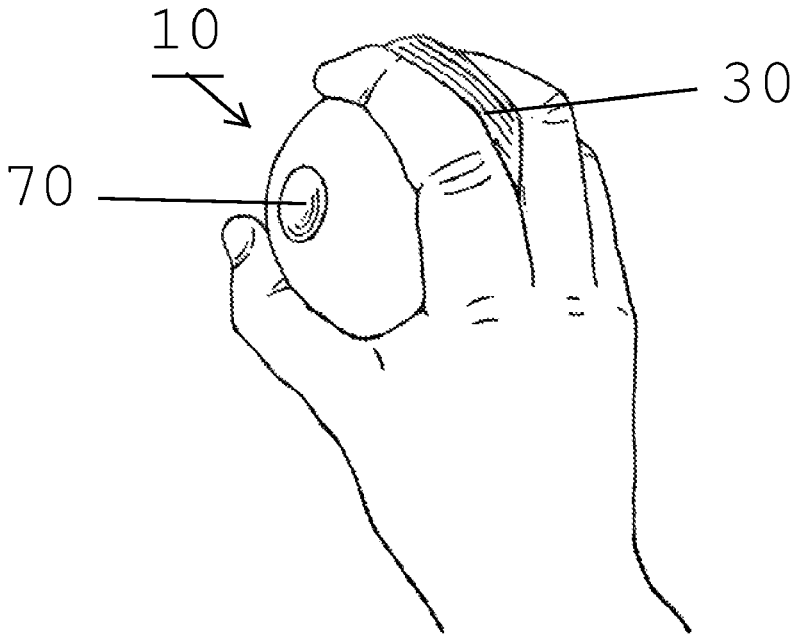
FIG. 6 is an illustrated perspective view of a hand gripping an exemplary embodiment of the present invention.
Figure 7:
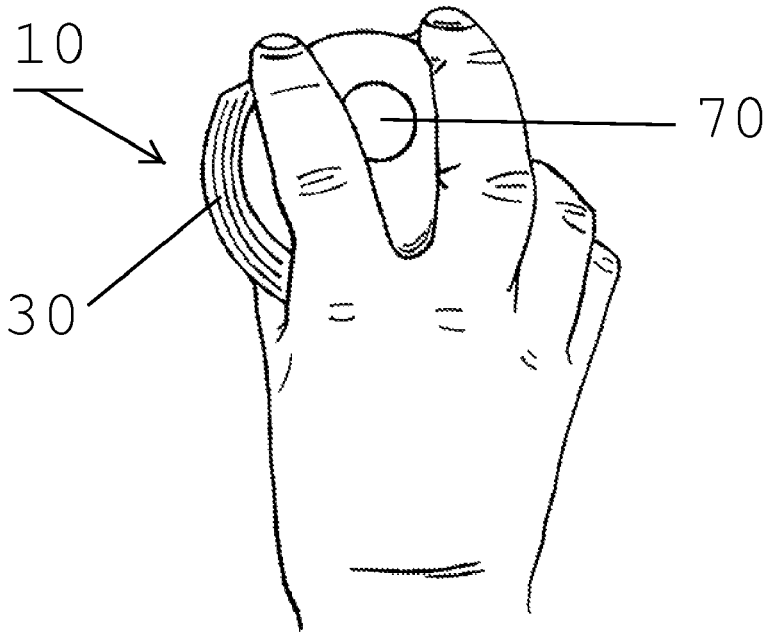
FIG. 7 is an illustrated perspective view of a hand gripping an exemplary embodiment of the present invention.

In a preferred embodiment of the present invention, the training baseball is gripped in one of two ways. For a first grip, and as best shown in FIG. 6, to throw a curve ball, the training baseball is gripped such that one of the two or more elongated fins is positioned substantially between an index finger and a middle finger of a throwing hand. For the second grip, and as best displayed in FIG. 7, to throw a screw ball, the training baseball is gripped such that the marking is positioned substantially between an index finger and a middle finger of a throwing hand. The training baseball may be used by right-handed and left-handed pitchers.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A training baseball comprised of:

a ball having a substantially spherical shape; and two or more elongated fins, wherein the two or more elongated fins project from an outer surface of the ball, and wherein the two or more elongated fins are positioned on substantially opposing sides of a circumference of the ball, such that the two or more elongated fins are positioned substantially within a common plane and the common plane substantially bisects the ball to create a first side and a second side, wherein both the first side and the second side have a substantially hemispherical shape and wherein the first side has a first side weight and the second side has a second side weight, such that the first side weight is greater than the second side weight.

2. A training baseball according to claim 1, wherein the ball is substantially solid.

3. A training baseball according to claim 1, wherein the ball is substantially hollow, and wherein the ball is comprised of a wall thickness.

4. A training baseball according to claim 3, wherein the wall thickness is uniform throughout the ball.

5. A training baseball according to claim 3, wherein the first side is comprised of a first side wall thickness and the second side is comprised of a second side wall thickness, wherein the first side wall thickness is greater than the second side wall thickness.

6. A training baseball according to claim 1, wherein the two or more elongated fins are pliant, such that the two or more elongated fins will substantially bend upon contact with a bat.

7. A training baseball according to claim 1, wherein the ball is further comprised of a marking, wherein the marking is positioned on the outer surface of the ball substantially at a point at which a central axis passes through the outer surface on the first side, wherein the central axis extends through a center of the ball and is substantially perpendicular to the common plane.

8. A method of throwing a training baseball comprising the steps of:

gripping a training baseball, wherein the training baseball is comprised of:

a ball having a substantially spherical shape; and two or more elongated fins, wherein the two or more elongated fins project from an outer surface of the ball, and wherein the two or more elongated fins are positioned on substantially opposing sides of a circumference of the ball, such that the two or more elongated fins are positioned substantially within a common plane and the common plane substantially bisects the ball to create a first side and a second side, wherein both the first side and the second side have a substantially hemispherical shape and wherein the first side has a first side weight and the second side has a second side weight, such that the first side weight is greater than the second side weight; and throwing the training baseball in a straight-throw motion.

9. A method of throwing a training baseball according to claim 8, wherein the training baseball is gripped such that one of the two or more elongated fins is positioned substantially between an index finger and a middle finger of a throwing hand.

10. A method of throwing a training baseball according to claim 8, wherein the ball is further comprised of a marking, wherein the marking is positioned on the outer surface of the ball substantially at a point at which a central axis passes through the outer surface on the first side, wherein the central axis extends through a center of the ball and is substantially perpendicular to the common plane, and wherein the training baseball is gripped such that the marking is positioned substantially between an index finger and a middle finger of a throwing hand.

11. A method of throwing a training baseball according to claim 8, wherein the ball is substantially solid.

12. A method of throwing a training baseball according to claim 8, wherein the ball is substantially hollow, and wherein the ball is comprised of a wall thickness.

13. A method of throwing a training baseball according to claim 12, wherein the wall thickness is uniform throughout the ball.

14. A method of throwing a training baseball according to claim 12, wherein the first side is comprised of a first side wall thickness and the second side is comprised of a second side wall thickness, wherein the first side wall thickness is greater than the second side wall thickness.

15. A method of throwing a training baseball according to claim 8, wherein the two or more elongated fins are pliant, such that the two or more elongated fins will substantially bend upon contact with a bat.

* * * * *